US005103744A

United States Patent [19]

Tunströmer

[11] Patent Number: 5,103,744

[45] Date of Patent: Apr. 14, 1992

[54] APPARATUS FOR THE COMBUSTION AND/OR DECOMPOSITION OF FUEL BY HEAT, ESPECIALLY OF SOLID FUELS

[76] Inventor: Nils E. Tunströmer, Mullsjö, Sweden

[21] Appl. No.: 549,016

[22] PCT Filed: Jan. 25, 1990

[86] PCT No.: PCT/EP90/00142

§ 371 Date: Sep. 18, 1990

§ 102(e) Date: Sep. 18, 1990

[87] PCT Pub. No.: WO90/08918

PCT Pub. Date: Aug. 9, 1990

[30] Foreign Application Priority Data

Jan. 25, 1989 [DE] Fed. Rep. of Germany ..... 3902159

[51] Int. Cl.[5] ..... F23B 7/00

[52] U.S. Cl. ..... 110/233; 110/165 R; 110/235; 110/258; 110/259; 110/285; 110/309; 126/152 B

[58] Field of Search ..... 110/258, 222, 196, 197, 110/259, 285, 165 R, 291, 233, 235, 309; 126/173, 155, 152 B

[56] References Cited

U.S. PATENT DOCUMENTS

| | | | |
|---|---|---|---|
| 4,796,544 | 1/1989 | Overgaard | 110/196 |
| 4,884,516 | 12/1989 | Linsen | 110/285 X |
| 4,895,084 | 1/1990 | Kroon et al. | 110/259 X |
| 4,901,653 | 2/1990 | Baltzinger | 110/291 X |

FOREIGN PATENT DOCUMENTS

| | | | |
|---|---|---|---|
| 668440 | 12/1938 | Fed. Rep. of Germany . | |
| 3302380 | 7/1984 | Fed. Rep. of Germany | 110/196 |
| 648135 | 12/1950 | United Kingdom . | |

*Primary Examiner*—Edward G. Favors
*Attorney, Agent, or Firm*—Lorusso & Loud

[57] ABSTRACT

An apparatus for the combustion and/or decomposition of fuel by heat, especially of solid fuels such as peat, coal, wood, straw or garbage, comprising a fuel supply and air supply to a bar grate which is used as combustion site and cooperates with material loosening means in the form of disks, prongs or the like which extend through the grate interstices and are mounted on a support member which extends transversely to the grate bars, in which the disks are reciprocable relative to the grate bars in the direction towards the same. The material loosening disks are fitted onto support members each in the form of a support rod of substantially rectangular cross-section such that the disks are individually displaceable in the direction of the support rod.

14 Claims, 3 Drawing Sheets

APPARATUS FOR THE COMBUSTION AND/OR DECOMPOSITION OF FUEL BY HEAT, ESPECIALLY OF SOLID FUELS

The present invention is directed to an apparatus for the combustion and/or decomposition of fuel by heat, especially of solid fuels such as peat, coal, wood, straw or garbage, as specified in the preamble of claim 1.

When solid fuels are combusted and/or decomposed by heat on a bar grate it is inevitable that the grate will become clogged by the deposition of fuel and/or slag or like materials in the course of the process, thus resulting in an increasingly poorer efficiency. This problem has been known for decades in connection with smaller coal or wood stoves. Therefore deposited residues of combustion must be removed from the grate from time to time by means of a poker or the like so as to maintain combustion.

There also exist furnaces which are provided with vibratory grates for the said purpose. However, with major heating installations these measures cannot be adopted. Besides, they have only little effect.

DE-A-116,441 discloses a vibrating cage grate which is characterized in that stationary prongs engage within the interstices of the grate to break up the deposited slag during the movement of the grate. However, the prongs are effective only acorss a part of the cage grate so that the efficiency of the known structure is correspondingly limited. Moreover, it has been found that the bars of the grate become distorted due to local thermal stresses and consequently the stationary prongs rub against the grate bars and in extreme cases may even block the vibrations of the grate. Moreover, the bars of the grate are made from solid material so that they are particularly susceptible to thermal stresses.

In order to eliminate the specified problems it has been proposed in DE-C-3,418,864 that the material loosening means engaging in the interstices of the grate should be mounted with some clearance, i.e. it should be movable with respect to the bars of the grate. Thereby any blocking of the vibratory grate due to distortions of the grate bars as caused by heat is largely prevented, and combustion is correspondingly promoted The risk of clogging of the bar grate is considerably reduced.

In order to reduce the above-mentioned distortions of the grate bars it has also been proposed to configure the same in the form of pipe lengths through which a cooling medium, especially air, is passed (DE-A-3,334,024 and DE-A-3,149,548). However, under extreme conditions these measures are insufficient to ensure unobstructed relative movement between the grate bars and the material loosening means In such a case the additional measures as specified in DE-C-3,418,864 have been found to be indispensible.

The present invention is based on the object of further improving the structure according to DE-C-3,418,864 in such a way that the material loosening means, which are subject to considerable wear, can easily be exchanged or can be replaced by material loosening means of a different kind.

The specified object is solved by the characterizing features of claim 1. Accordingly, it is readily possible to exchange the material loosening means without having to dismantle the bar grate structure, especially the support members for the material loosening means, or to replace them by material loosening means of a different kind. Also, it is possible to vary or change the number of material loosening means used while dismantling of the afore-mentioned arrangement or support member is not required. In accordance with the invention, the material loosening means in the form of disks or plates are fitted in an extremely simple manner on the support member which extends beneath the grate bars and is configured as a support rod of essentially rectangular cross-section, so that said disks or plates are individually displaceable in the direction of the support rod. Accordingly, fitting of the material loosening disks to the support rod is effected with sufficiently large play.

Preferred structural details of the material loosening disks according to the invention are described in claims 2 and 3.

When grate bars in the form of pipe lengths are used through which a cooling liquid is passed, it is advantageous according to claim 4 that covering hoods made from refractory and heatproof material such as special steel, ceramics or the like, are disposed on the tops of the pipe lengths. The grate bars which are also used as cooling pipes are protected by these covering hoods from mechanical damage and extreme thermal effects. Preferably, the covering hoods are joined e.g. by welding to the respective associated pipe length at only one location so as to avoid thermal stresses between the covering hoods and their associated pipe lengths.

Also, the measures specified in claim 8 and the following claims are of particular significance, in which the supply of air as specified in claims 9 to 11 provides for cooling of the grate bars and also for increased combustion of the fuel. The measures specified in claim 9 are especially directed to this end, according to which the introduced primary air is directed in such a way that it tends to pass through the bar grates from bottom to top. In this way the fuel to be combusted is practically "lifted off" the bar grates and loosened from below. Furthermore, the described cooling of the grate bars by blowing air against the bottom of the bar grates effectively delays the formation of slag and thus clogging of the bar grates. This applies especially when straw is combusted, which has a considerable tendency to slag formation. For the rest, the above-mentioned material loosening means also contribute to reliably preventing any clogging of the bar grates even under extreme conditions.

The feeding of air as specified in claim 10 is primarily intended to improve combustion or decomposition of the fuel by heat.

As specified in claim 11, throttle members cooperate with the air supply, these being preferably in the form of reducing dampers which can be operated either individually or jointly so that the rate of flow can accordingly be varied or matched with the desired combustion or decomposition by heat.

Also, the features of claims 12 to 14 are particularly significant even independently of the afore-mentioned measures; thereby ashes or the like can be discharged or removed from the combustion area in an especially simple and effective way.

Finally, the stepped arrangement of a plurality of bar grates achieves better distribution of the material to be combusted, said distribution being mainly effected by the reciprocable material loosening means. Accordingly, the material loosening means provided in accordance with the invention exhibit a dual function in the concrete embodiment of the apparatus as claimed in claim 8.

Below, an especially preferred embodiment of the apparatus of the invention will be explained with reference to the accompanying drawing, in which.

Figure 1:
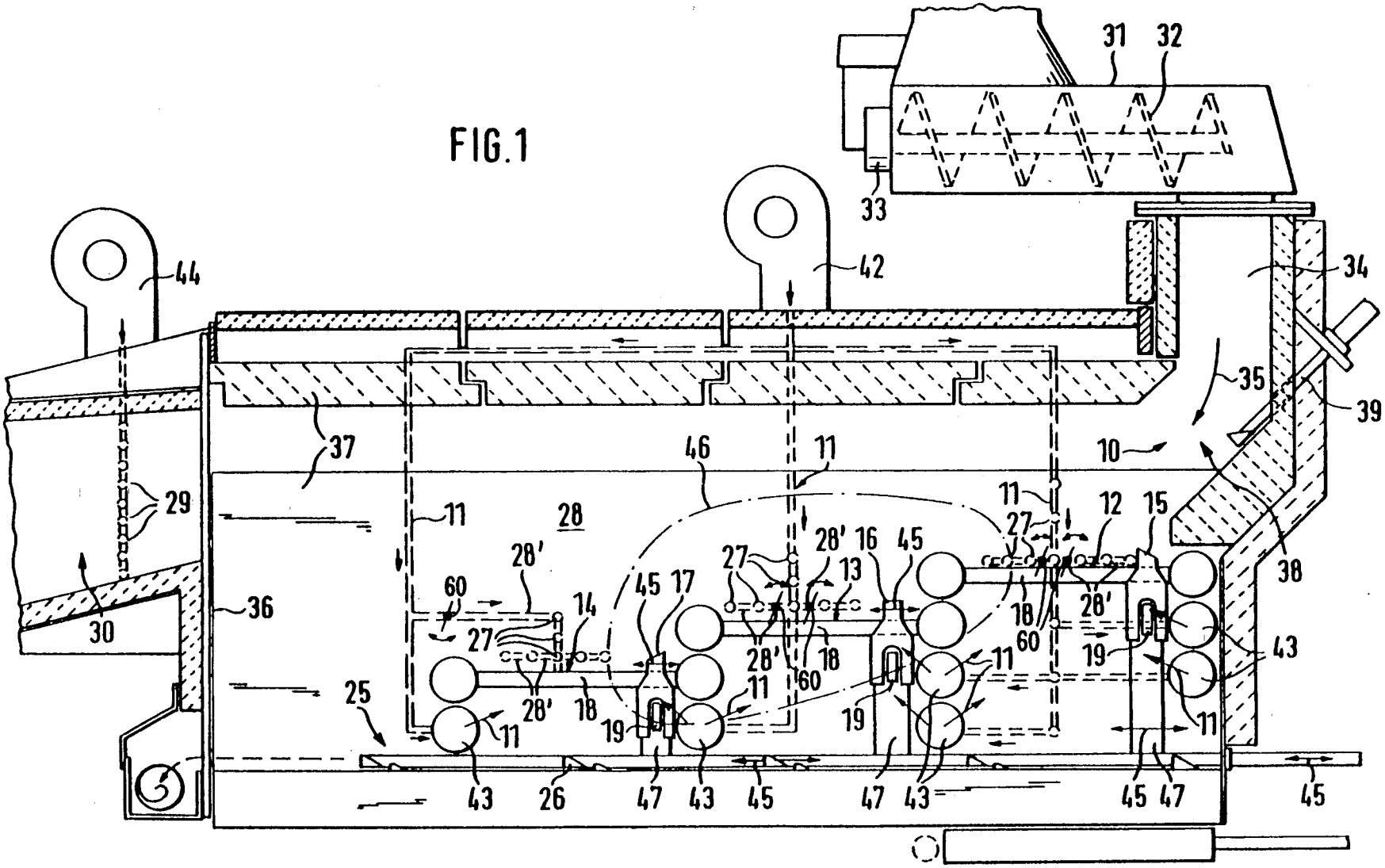
FIG. 1 is a schematic side view of an apparatus according to the invention.

FIG. 1 is a schematic side view illustrating an apparatus for the combustion of solid fuels, especially straw and preferably in pelletized form, comprising a fuel inlet 10 and three combustion sites in the form of three bar grates 12, 13 and 14 which are serially arranged in stepped fashion within a combustion chamber 28. The fuel inlet comprises a horizontally extending tubular fuel feed passage 31 within which a rotatably driven feed screw 32 is disposed or mounted, said feed screw 32 being driven by a correspondingly flanged electric or other motor 33. The feed screw passage 31 opens into a vertical shaft 34 through which the nearest bar grate 12 is fed with fuel. Fuel feeding is effected in the direction of the arrow 35. Each of the bar grates 12, 13 and 14 has material loosening means cooperating therewith, which are configured as disks or plates 15, 16, 17 protruding through the interstices of the grates. The disks are respectively fitted with a clearance on support rods which extend transversely to the grate bars 18 and have substantially rectangular cross-section, so that the disks are adapted to be individually displaced in the direction of the support rods 19. The support rods 19 are coupled with an oscillatory drive means in the form of a bidirectional cylinder-and-piston unit. Coupling is respectively effected to the portion of the piston rod extending from the cylinder of the cylinder-and-piston unit. Additionally, the piston rod has mounted thereon rake members of a rake conveyor 26, said rake members extending transversely to the grate bars 18 and in parallel with the support rods 19 and each having triangular cross-section, one side extending approximately in parallel and the other, i.e. the front side which faces away from the fuel inlet, extending approximately vertically and the third side extending at a slight inclination to a bottom 25 which is disposed beneath the bar grates 12, 13, 14. Concretely, the mentioned rake members of the rake conveyor 26 are disposed beneath the respective cooperating loosening disks 15, 16, 17 such that the lower, bottom-facing side of the respective rod-like rake members rests on the bottom 25. The described cross-sectional configuration of the rod-like rake members offers the advantage that upon movement thereof in the direction away from the fuel inlet the upright sides become effective to push off ashes or the like that drop to the bottom 25. During the return movement of the rake conveyor 26, the rake members constituting the rake conveyor merely "move under" the ashes on the bottom 25 due to the slightly inclined configuration of their rear sides. Irrespective of the oscillatory movement of the rake conveyor 26, any ashes or the like dropping onto the bottom 25 are merely pushed in the direction away from the fuel inlet to a pressure-type collecting vessel which is not illustrated in detail and into which a feed screw extends by which the ashes or the like pushed off the bottom 25 may be conveyed from the apparatus. The final discharge of ashes or the like may then be effected through a conveying hose which is coupled to the discharge-side end of the last-mentioned feed screw.

The combustion chamber 28 is defined by the bar grates 12, 13, 14 on the one hand and by an end wall 36 and a top and sidewall 37 each of refractory material, on the other hand, the top wall continuing to form a discharge passage 30 which in turn opens into a flue gas outlet or the like. The fuel entry portion, which is indicated at 38 in FIG. 1, cooperates with a hot-air lance 39 through which ignition of the fuel is to be initiated and promoted in combination with an igniter (not illustrated). Preferably, a photoelectric cell is provided in the vicinity of the fuel entry portion 38 and above the same and indicates whether proper combustion takes place and in case of improper combustion triggers the interruption of any further fuel supply. The photoelectric cell could also be coupled to the air supply means 11 in such a way that the latter is controlled in accordance with the detected combustion, whereby optimum combustion will take place.

Figure 2:
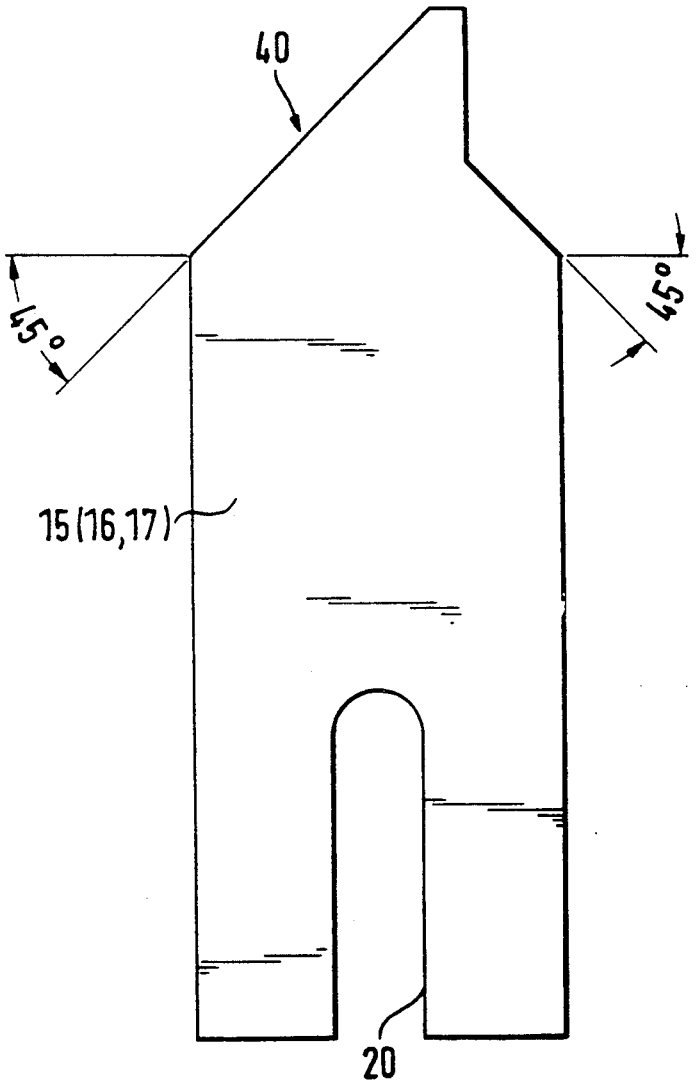
FIG. 2 is a side view of a material loosening disk designed in accordance with the invention.

As will be apparent from FIG. 2, the respective material loosening disks 15, 16 and 17 are approximately rectangular plates of refractory and heatproof material and each have a slot 20 on one side which corresponds to the cross-section of the cooperating support rod 19, the cross-sectional width of the support rod 19 having a slightly smaller dimension than the internal width of the slot 20 into which the support rod 19 is inserted when the disks 15, 16, 17 have been fitted. Therefore the disks 15, 16, 17 may be mounted without dismantling the support rods 19 or the bar grates 12, 13, 14, i.e. they may be fitted on the cooperating support rods 19 while extending between two adjacent grate bars.

The upper side 40, or the side protruding upwards between the grate bars 18, of each of the material loosening disks 15, 16, 17 may be formed with an inclination in the direction to the fuel inlet 10 or the fuel entry portion 38 either downwardly (loosening disks 15 in FIG. 1) or upwardly (loosening disks 17 in FIG. 1). The loosening disks 16 cooperating with the central bar grate 13 have an upper edge which extends approximately horizontally or in parallel with the grate bars 18.

The width of the loosening disks 15, 16, 17 depends on the spacing between two adjacent grate bars. It is somewhat less than the last-mentioned spacing, and in a concrete embodiment it is about 10 mm.

Figure 3:
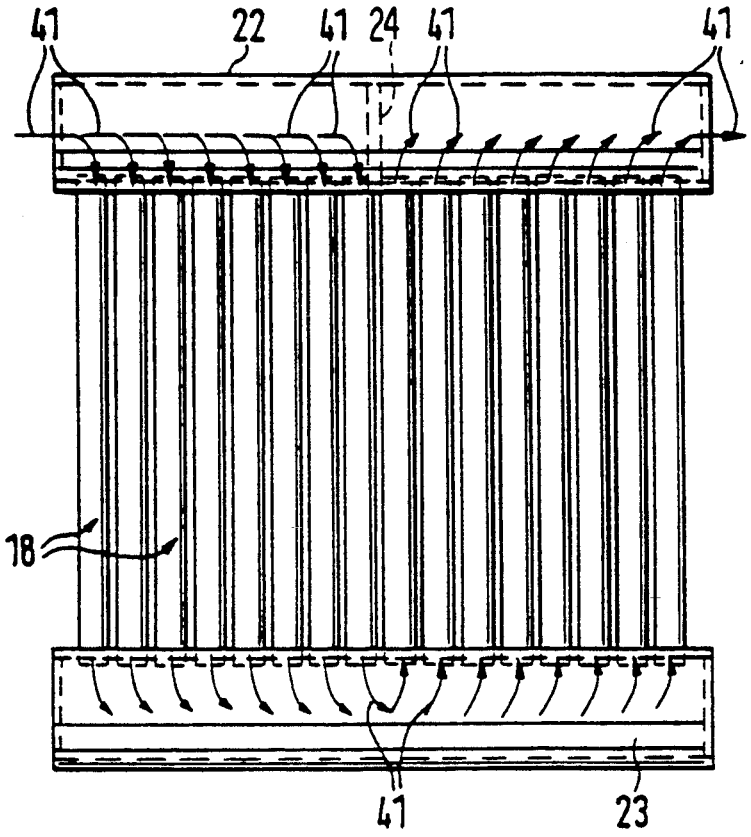
FIG. 3 is a plan view showing a bar grate including bar-forming pipe lengths through which a cooling liquid is passed.
Figure 4:
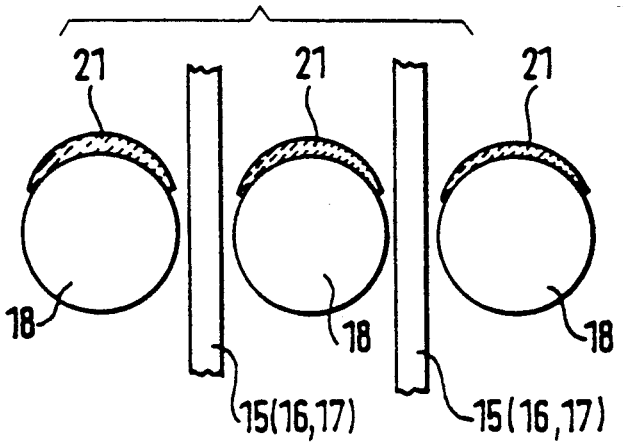
FIG. 4 is an enlarged cross-sectional view illustrating pipe lengths used as grate bars and including a "protective hood".

As shown in FIGS. 3 and 4, the grate bars 18 are configured as pipe lengths through which a cooling liquid, i.e. water, is passed. The tops of the pipe lengths are provided with covering hoods 21 serving as protective hoods of refractory and heatproof material such as special steel, ceramics or the like. These protective or covering hoods extend substantially along the entire length of the pipe lengths. However, they are joined to the respective pipe lengths at one location only so as to prevent the occurrence of thermal stresses between covering hoods on the one hand and associated pipe lengths, on the other hand. As will be apparent from FIG. 4, the covering hoods 21 extend transversely to the longitudinal extension of the pipe lengths through an angular range of about 100° to 120°. In this way the operation of the material loosening disks disposed between adjacent pipe lengths is not impaired.

The ends of the pipe lengths forming the grate bars 18 open into a cooling water inlet and outlet chamber 22, on the one hand, and into a cooling water transfer chamber 23, on the other hand, said cooling water inlet and outlet chamber 22 including a partition wall 24 by means of which the inlet area is separated from the outlet area. Accordingly, cooling water flows through said inlet area into a predetermined number of pipe lengths which—as viewed in the direction of flow—are upstream of the partition wall 24. Through the diametrically disposed cooling water transfer chamber 23 the cooling water is then passed into the remaining pipe lengths from which it will exit through the outlet area of the cooling water inlet and outlet chamber 22. The illustrated liquid flow through the pipe lengths forming the grate bars 18 is indicated by the arows 41 in FIG. 3. It is preferred that temperature sensors cooperate with both the inlet and the outlet area of each bar grate for controlling the flow rate of cooling liquid so that after a short operating time a substantially constant and predetermined flow temperature of the cooling medium will be achieved.

It is of particular importance to the combustion and also to the prevention of slag formation in the vicinity of the bar grates to make provision for supplying air to the bar grates 12, 13, 14, i.e. pressurized air in such a way that every single bar grate has a flow of air directed obliquely towards its underside as indicated at 11 in FIG. 1. Moreover, a further air supply means is defined by air ducts 28 which are respectively disposed just above and laterally of the bar grates 12, 13 and 14, said air ducts each having air inlet openings 27 directed towards the bar grates. The specified air supply means is variable in respect of flow rate by means of individually or jointly operated reducing and/or closing dampers 60. Since these are per se known structural measures they are not illustrated in detail in FIG. 1. The described supply of air is effected by a blower 42 disposed externally of the apparatus. The air supply ducts leading to the air inlet openings below and above as well as laterally of the bar grates are referenced 11 and 28 in FIG. 1. These air supply ducts extend in the vicinity of the sidewalls of the combustion chamber 28. Beneath the bar grates, air collecting pipes 43 are respectively disposed at the ends which extend transversely through the combustion chamber 28 and have air outlet openings which permit the air to be blown obliquely towards the bottom of the bar grates.

It may be advantageous for a further reduction of the CO-content to provide additional openings in the vicinity of the discharge passage 30 for the purpose of introducing secondary air; in the illustrated embodiment a multiplicity of such openings is approximately equally distributed about the circumference of the discharge passage 30. The mentioned secondary air is supplied by a seaprate blower 44.

It is apparent from FIG. 1 that the material loosening disks 15, 16 and 17 project from the top of the respective cooperating bar grates by a distance which corresponds approximately to the diameter of the grate bars 18. The oscillatory reciprocating movement of both the material loosening disks and the rake conveyor 26 for raking the ashes is indicated in FIG. 1 by the dual arrow 45.

The main combustion zone is in the vicinity of the central bar grate 13 and is encircled by a dash-dot line 46 in FIG. 1.

The fuel supply means especially in the vicinity or, preferably, upstream of the fuel feed screw 32 may also be provided with an inlet for quenching water, said inlet being connected to a water reservoir by way of a check valve. In case of overheating and in response to a signal triggered, for instance, by the mentioned photoelectric cell, the mentioned valve is opened so that quenching water may escape from the water reservoir into the fuel supply area. Wet fuel will then reach the area of the bar grates so that combustion will cease. Additionally, quenching water will flow direct into the combustion chamber. However, this way of interrupting combustion is intended only for an emergency.

Of course, the oscillatingly driven material loosening disks 15, 16, 17, on the one hand, and the also oscillatingly driven rake conveyor 26 for raking ashes, on the other hand, may have separate oscillating drive means in the form of cylinder-and-piston units cooperating therewith It is, however, preferred to use a common drive means in which the support rods 19 must be coupled to the rake conveyor 26, i.e. must be rigidly connected thereto as indicated in FIG. 1 by lateral connecting arms 47.

All of the features described in the present application papers are claimed as being essential to the invention to the extent to which they are novel over the prior art either individually or in combination.

I claim:

1. An apparatus for combustion and/or decomposition of fuel by heat, especially of solid fuels such as peat, coal, wood, straw or garbage, comprising:

a fuel supply and an air supply to a bar grate used as a combustion site, said bar grate cooperating with a material loosening means which extends through interstices of said bar grate, said material loosening means comprising material loosening disks mounted with play on a support member extending transversely to said grate bars, said material loosening disks being adapted for reciprocating motion in the direction towards said grate bars relative thereto, said material loosening disks being adapted to be fitted on said support member, said support member extending beneath said grate bars and comprising a support rod having substantially rectangular cross-section, such that said material loosening disks are individually displaceable in the direction towards said support rod, said material loosening disks being approximately rectangular plates made from refractory and heatproof material and each including on one side thereof a slot corresponding to the cross-section of said support rod, said cross-sectional width of said support rod being slightly smaller than the internal width of the slot into which said support rod is inserted when a disk is fitted thereon.

2. The apparatus as in claim 1 wherein the upper side or, respectively, the side protruding upwardly from between the grate bars of said material loosening disks is inclined either downwardly or upwardly in the direction towards the fuel entry portion.

3. The apparatus as in claim 1 wherein the grate bars are constituted by pipe lengths through which a cooling liquid, especially cooling water, is passed, and that covering hoods used as protective hoods made from refractory and heatproof material such as special steel or ceramics are disposed on the tops of the pipe lengths.

4. The apparatus as claimed in claim 3, characterized in that the covering hoods, which extend substantially along the entire length of said pipe lengths, are each fixedly connected to their associated pipe lengths at one location only.

5. The apparatus as claimed in claim 3, characterized in that the covering hoods extend across an angular range of about 100° to 120° relative to the cross-section of the pipe lengths.

6. The apparatus as claimed in claim 3, characterized in that the ends of the pipe lengths forming the grate bars open into a cooling water inlet and outlet chamber, on the one hand, and into a cooling water transfer chamber, on the other hand, the cooling water inlet and outlet chamber (22) including a partition wall (24) by means of which the inlet area is separated from the outlet area.

7. The apparatus as in claim 1 wherein at least two and preferably three bar grates are provided as combustion sites which as a continuation of the fuel inlet are arranged in a series and in mutually stepped fashion, all of the bar grates having a common bottom on which a reciprocable rake conveyor is mounted for moving ashes dropping from the bar grates towards a common discharge means, especially a feed screw.

8. The apparatus as in claim 1 wherein each bar grate has a separate and preferably individually controllable air supply means cooperating therewith through which primary air, especially ambient air, can be introduced under pressure in such a way that air is blown obliquely against the under side of each individual bar grate.

9. The apparatus as claimed in claim 8, characterized in that further air supply means are defined by air ducts respectively mounted just above and laterally of the bar grate(s), said air ducts including air inlet openings respectively directed towards the bar grates.

10. The apparatus as in claim 8 wherein the air supply means is variable in respect of the air flow rate, especially by means of individually operated reducing and/or closing dampers.

11. The apparatus as in claim 1 wherein the support rods for the material loosening disks are coupled to a preferably joint oscillatory drive means.

12. The apparatus as claimed in claim 7 characterized in that the rake conveyor is coupled to an oscillatory drive means and preferably to the oscillatory drive means for the material loosening disks cooperating with the bar grates.

13. The apparatus as claimed in claim 7 characterized in that the rake conveyor comprises a plurality of raking members each having triangular cross-section, said raking members being spaced from each other and extending closely above said bottom and transversely to the grate bars and transversely to the direction of their oscillatory movement, wherein the underside extends approximately in parallel to the bottom while the other or front side which faces away from the fuel entry portion extends approximately vertically and the third or top side which faces towards the fuel entry portion extends at a slight inclination to said bottom.

14. The apparatus as in claim 1 wherein the outlet of the combustion chamber comprising the bar grates is provided with openings for introducing secondary air, wherein preferably a multiplicity of such openings is approximately equally distributed about the circumference of the discharge passage which is a continuation of the combustion chamber.

* * * * *